US007868829B1

(12) United States Patent
Colburn et al.

(10) Patent No.: US 7,868,829 B1
(45) Date of Patent: Jan. 11, 2011

(54) REFLECTARRAY

(75) Inventors: Joseph S. Colburn, Malibu, CA (US); Daniel F. Sievenpiper, Los Angeles, CA (US); Sarabjit Mehta, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 224 days.

(21) Appl. No.: 12/053,127

(22) Filed: Mar. 21, 2008

(51) Int. Cl.
*H01Q 1/38* (2006.01)
*H01Q 9/00* (2006.01)

(52) U.S. Cl. ..... 343/700 MS; 343/745

(58) Field of Classification Search ..... 343/700 MS, 343/745, 754, 755, 756, 767, 770, 909
See application file for complete search history.

(56) References Cited

U.S. PATENT DOCUMENTS

| | | | | |
|---|---|---|---|---|
| 3,267,480 | A | 8/1966 | Lerner | 343/911 |
| 3,560,978 | A | 2/1971 | Himmel et al. | 343/106 |
| 3,810,183 | A | 5/1974 | Krutsinger et al. | 343/708 |
| 3,961,333 | A | 6/1976 | Purinton | 343/872 |
| 4,045,800 | A | 8/1977 | Tang et al. | 343/854 |
| 4,051,477 | A | 9/1977 | Murphy et al. | 343/700 MS |
| 4,119,972 | A | 10/1978 | Fletcher et al. | 343/844 |
| 4,123,759 | A | 10/1978 | Hines et al. | 343/854 |
| 4,124,852 | A | 11/1978 | Steudel | 343/854 |
| 4,127,586 | A | 11/1978 | Rody et al. | 260/308 B |
| 4,150,382 | A | 4/1979 | King | 343/754 |
| 4,173,759 | A | 11/1979 | Bakhru | 343/100 |
| 4,189,733 | A | 2/1980 | Malm | 343/100 SA |
| 4,217,587 | A | 8/1980 | Jacomini | 343/100 SA |
| 4,220,954 | A | 9/1980 | Marchland | 343/113 R |
| 4,236,158 | A | 11/1980 | Daniel | 343/100 LE |
| 4,242,685 | A | 12/1980 | Sanford | 343/770 |
| 4,266,203 | A | 5/1981 | Saudreau et al. | 333/21 A |
| 4,308,541 | A | 12/1981 | Seidel et al. | 343/786 |
| 4,367,475 | A | 1/1983 | Schiavone | 343/767 |
| 4,370,659 | A | 1/1983 | Chu et al. | 343/772 |
| 4,387,377 | A | 6/1983 | Kandler | 343/756 |
| 4,395,713 | A | 7/1983 | Nelson et al. | 343/713 |
| 4,443,802 | A | 4/1984 | Mayes | 343/729 |

(Continued)

FOREIGN PATENT DOCUMENTS

DE 196 00 609 A1 4/1997

(Continued)

OTHER PUBLICATIONS

Balanis, C., "Aperture Antennas," *Antenna Theory, Analysis and Design*, 2nd Edition, Ch. 12, pp. 575-597 (1997).

(Continued)

*Primary Examiner*—Hoang V Nguyen
(74) *Attorney, Agent, or Firm*—Ladas & Parry

(57) ABSTRACT

A reflectarray is disclosed. The reflectarray includes a first array of conductive patches supported by a substrate, wherein each conductive patch in the first array has a first center line along a Y-direction and a second centerline along an X-direction, a plurality of first variable capacitors, wherein each first variable capacitor is electrically coupled to one of the conductive patches in the first array along the first centerline, and a plurality of second variable capacitors, wherein each second variable capacitor is electrically coupled to one of the conductive patches in the first array along the second centerline.

27 Claims, 14 Drawing Sheets

U.S. PATENT DOCUMENTS

| | | | | |
|---|---|---|---|---|
| 4,529,987 | A * | 7/1985 | Bhartia et al. | 343/700 MS |
| 4,590,478 | A | 5/1986 | Powers et al. | 343/700 MS |
| 4,594,595 | A | 6/1986 | Struckman | 343/770 |
| 4,672,386 | A | 6/1987 | Wood | 343/770 |
| 4,684,953 | A | 8/1987 | Hall | 343/725 |
| 4,700,197 | A | 10/1987 | Milne | 343/837 |
| 4,737,795 | A | 4/1988 | Nagy et al. | 343/712 |
| 4,749,996 | A | 6/1988 | Tresselt | 343/700 MS |
| 4,760,402 | A | 7/1988 | Mizuno et al. | 343/713 |
| 4,782,346 | A | 11/1988 | Sharma | 343/795 |
| 4,803,494 | A | 2/1989 | Norris et al. | 343/770 |
| 4,821,040 | A | 4/1989 | Johnson et al. | 343/700 MS |
| 4,835,541 | A | 5/1989 | Johnson et al. | 343/713 |
| 4,843,400 | A | 6/1989 | Tsao et al. | 343/700 MS |
| 4,843,403 | A | 6/1989 | Lalezari et al. | 343/767 |
| 4,853,704 | A | 8/1989 | Diaz et al. | 343/767 |
| 4,903,033 | A | 2/1990 | Tsao et al. | 343/700 MS |
| 4,905,014 | A | 2/1990 | Gonzalez et al. | 343/909 |
| 4,916,457 | A | 4/1990 | Foy et al. | 343/770 |
| 4,922,263 | A | 5/1990 | Dubost et al. | 343/797 |
| 4,958,165 | A | 9/1990 | Axford et al. | 343/770 |
| 5,021,795 | A | 6/1991 | Masiulis | 343/700 MS |
| 5,023,623 | A | 6/1991 | Kreinheder et al. | 343/725 |
| 5,070,340 | A | 12/1991 | Diaz | 343/767 |
| 5,081,466 | A | 1/1992 | Bitter, Jr. | 343/767 |
| 5,115,217 | A | 5/1992 | McGrath et al. | 333/246 |
| 5,146,235 | A | 9/1992 | Frese | 343/895 |
| 5,158,611 | A | 10/1992 | Ura et al. | 106/499 |
| 5,208,603 | A | 5/1993 | Yee | 343/909 |
| 5,235,343 | A | 8/1993 | Audren et al. | 343/816 |
| 5,268,696 | A | 12/1993 | Buck et al. | 342/372 |
| 5,268,701 | A | 12/1993 | Smith | 343/767 |
| 5,278,562 | A | 1/1994 | Martin et al. | 342/1 |
| 5,287,116 | A | 2/1994 | Iwasaki et al. | 343/700 MS |
| 5,287,118 | A | 2/1994 | Budd | 343/909 |
| 5,402,134 | A | 3/1995 | Miller et al. | 343/742 |
| 5,406,292 | A | 4/1995 | Schnetzer et al. | 343/700 MS |
| 5,519,408 | A | 5/1996 | Schnetzer | 343/767 |
| 5,525,954 | A | 6/1996 | Komazaki et al. | 333/219 |
| 5,531,018 | A | 7/1996 | Saia et al. | 29/622 |
| 5,532,709 | A | 7/1996 | Talty | 343/819 |
| 5,534,877 | A | 7/1996 | Sorbello et al. | 343/700 MS |
| 5,541,614 | A | 7/1996 | Lam et al. | 343/792.5 |
| 5,557,291 | A | 9/1996 | Chu et al. | 343/725 |
| 5,581,266 | A | 12/1996 | Peng et al. | 343/770 |
| 5,589,845 | A | 12/1996 | Yandrofski et al. | 343/909 |
| 5,600,325 | A | 2/1997 | Whelan et al. | 342/13 |
| 5,611,940 | A | 3/1997 | Zettler | 73/514.16 |
| 5,619,365 | A | 4/1997 | Rhoads et al. | 359/248 |
| 5,619,366 | A | 4/1997 | Rhoads et al. | 359/248 |
| 5,621,571 | A | 4/1997 | Bantli et al. | 359/529 |
| 5,638,946 | A | 6/1997 | Zavracky | 200/181 |
| 5,644,319 | A | 7/1997 | Chen et al. | 343/702 |
| 5,694,134 | A | 12/1997 | Barnes | 343/700 |
| 5,721,194 | A | 2/1998 | Yandrofski et al. | 505/210 |
| 5,767,807 | A | 6/1998 | Pritchett | 342/374 |
| 5,808,527 | A | 9/1998 | De Los Santos | 333/205 |
| 5,874,915 | A | 2/1999 | Lee et al. | 342/375 |
| 5,892,485 | A | 4/1999 | Glabe et al. | 343/789 |
| 5,894,288 | A | 4/1999 | Lee et al. | 343/770 |
| 5,905,465 | A | 5/1999 | Olson et al. | 343/700 MS |
| 5,923,296 | A * | 7/1999 | Sanzgiri et al. | 343/700 MS |
| 5,923,303 | A | 7/1999 | Schwengler et al. | 343/853 |
| 5,926,139 | A | 7/1999 | Korisch | 343/702 |
| 5,929,819 | A | 7/1999 | Grinberg | 343/754 |
| 5,943,016 | A | 8/1999 | Snyder, Jr. et al. | 343/700 MS |
| 5,945,951 | A | 8/1999 | Monte et al. | 343/700 MS |
| 5,949,382 | A | 9/1999 | Quan | 343/767 |
| 5,966,096 | A | 10/1999 | Brachat | 343/700 MS |
| 5,966,101 | A | 10/1999 | Haub et al. | 343/767 |
| 6,005,519 | A | 12/1999 | Burns | 343/700 MS |
| 6,005,521 | A | 12/1999 | Suguro et al. | 343/700 MS |
| 6,008,770 | A | 12/1999 | Sugawara | 343/767 |
| 6,016,125 | A | 1/2000 | Johansson | 343/702 |
| 6,028,561 | A | 2/2000 | Takei | 343/767 |
| 6,028,692 | A | 2/2000 | Rhoads et al. | 359/245 |
| 6,034,644 | A | 3/2000 | Okabe et al. | 343/767 |
| 6,034,655 | A | 3/2000 | You | 345/60 |
| 6,037,905 | A | 3/2000 | Koscica et al. | 343/701 |
| 6,040,803 | A | 3/2000 | Spall | 343/700 MS |
| 6,046,655 | A | 4/2000 | Cipolla | 333/137 |
| 6,046,659 | A | 4/2000 | Loo et al. | 333/362 |
| 6,054,659 | A | 4/2000 | Lee et al. | 200/181 |
| 6,061,025 | A | 5/2000 | Jackson et al. | 343/700 MS |
| 6,075,485 | A | 6/2000 | Lilly et al. | 343/700 MS |
| 6,081,235 | A | 6/2000 | Romanofsky et al. | 343/700 MS |
| 6,081,239 | A | 6/2000 | Sabet et al. | 343/753 |
| 6,097,263 | A | 8/2000 | Mueller et al. | 333/17.1 |
| 6,097,343 | A | 8/2000 | Goetz et al. | 343/708 |
| 6,118,406 | A | 9/2000 | Josypenko | 343/700 MS |
| 6,118,410 | A | 9/2000 | Nagy | 343/713 |
| 6,127,908 | A | 10/2000 | Bozler et al. | 333/246 |
| 6,150,989 | A | 11/2000 | Aubry | 343/767 |
| 6,154,176 | A | 11/2000 | Fathy et al. | 343/700 MS |
| 6,166,705 | A | 12/2000 | Mast et al. | 343/853 |
| 6,175,337 | B1 | 1/2001 | Jasper, Jr. et al. | 343/770 |
| 6,175,723 | B1 | 1/2001 | Rothwell, III | 455/63 |
| 6,188,369 | B1 | 2/2001 | Okabe et al. | 343/767 |
| 6,191,724 | B1 | 2/2001 | McEwan | 342/21 |
| 6,198,438 | B1 | 3/2001 | Herd et al. | 343/700 MS |
| 6,198,441 | B1 | 3/2001 | Okabe et al. | 343/702 |
| 6,204,819 | B1 | 3/2001 | Hayes et al. | 343/702 |
| 6,218,912 | B1 | 4/2001 | Mayer | 333/106 |
| 6,218,997 | B1 | 4/2001 | Lindenmeier et al. | 343/725 |
| 6,246,377 | B1 | 6/2001 | Aiello et al. | 343/700 |
| 6,252,473 | B1 | 6/2001 | Ando | 333/105 |
| 6,285,325 | B1 | 9/2001 | Nalbandian et al. | 343/700 MS |
| 6,307,519 | B1 | 10/2001 | Livingston et al. | 343/767 |
| 6,317,095 | B1 | 11/2001 | Teshirogi et al. | 343/785 |
| 6,323,826 | B1 | 11/2001 | Sievenpiper et al. | 343/909 |
| 6,331,257 | B1 | 12/2001 | Loo et al. | 216/13 |
| 6,337,668 | B1 | 1/2002 | Ito et al. | 343/833 |
| 6,366,254 | B1 | 4/2002 | Sievenpiper et al. | 343/700 |
| 6,373,349 | B2 | 4/2002 | Gilbert | 333/126 |
| 6,380,895 | B1 | 4/2002 | Moren et al. | 343/700 MS |
| 6,388,631 | B1 | 5/2002 | Livingston et al. | 343/767 |
| 6,392,610 | B1 | 5/2002 | Braun et al. | 343/876 |
| 6,404,390 | B2 | 6/2002 | Sheen | 343/700 MS |
| 6,404,401 | B2 | 6/2002 | Gilbert et al. | 343/780 |
| 6,407,719 | B1 | 6/2002 | Ohira et al. | 343/893 |
| 6,417,807 | B1 | 7/2002 | Hsu et al. | 343/700 MS |
| 6,424,319 | B2 | 7/2002 | Ebling et al. | 343/911 L |
| 6,426,722 | B1 | 7/2002 | Sievenpiper et al. | 343/700 MS |
| 6,440,767 | B1 | 8/2002 | Loo et al. | 438/52 |
| 6,469,673 | B2 | 10/2002 | Kaiponen | 343/703 |
| 6,473,362 | B1 | 10/2002 | Gabbay | 367/119 |
| 6,483,480 | B1 | 11/2002 | Sievenpiper et al. | 343/909 |
| 6,496,155 | B1 | 12/2002 | Sievenpiper et al. | 343/770 |
| 6,515,635 | B2 | 2/2003 | Chiang et al. | 343/834 |
| 6,518,931 | B1 | 2/2003 | Sievenpiper | 343/700 |
| 6,525,695 | B2 | 2/2003 | McKinzie, III | 343/756 |
| 6,538,621 | B1 | 3/2003 | Sievenpiper et al. | 343/909 |
| 6,552,696 | B1 | 4/2003 | Sievenpiper et al. | 343/909 |
| 6,624,720 | B1 | 9/2003 | Allison et al. | 333/105 |
| 6,642,889 | B1 | 11/2003 | McGrath | 343/700 MS |
| 6,657,525 | B1 | 12/2003 | Dickens et al. | 335/78 |
| 6,680,703 | B1 * | 1/2004 | McConnell | 343/700 MS |
| 6,864,848 | B2 * | 3/2005 | Sievenpiper | 343/767 |
| 6,897,810 | B2 | 5/2005 | Dai et al. | 343/700 MS |
| 6,897,831 | B2 * | 5/2005 | McKinzie et al. | 343/909 |
| 6,917,343 | B2 * | 7/2005 | Sanchez et al. | 343/795 |
| 7,068,234 | B2 * | 6/2006 | Sievenpiper | 343/745 |
| 7,071,888 | B2 | 7/2006 | Sievenpiper | 343/745 |
| 7,154,451 | B1 | 12/2006 | Sievenpiper | 343/700 MS |

| | | | | |
|---|---|---|---|---|
| 7,164,387 | B2 | 1/2007 | Sievenpiper | 343/702 |
| 7,245,269 | B2 | 7/2007 | Sievenpiper et al. | 343/909 |
| 7,253,699 | B2 | 8/2007 | Schaffner et al. | 333/32 |
| 7,253,780 | B2 * | 8/2007 | Sievenpiper | 343/745 |
| 2001/0035801 | A1 | 11/2001 | Gilbert | 333/126 |
| 2002/0036586 | A1 | 3/2002 | Gothard et al. | 342/374 |
| 2003/0122721 | A1 | 7/2003 | Sievenpiper | 343/767 |
| 2003/0193446 | A1 | 10/2003 | Chen | 343/893 |
| 2003/0222738 | A1 | 12/2003 | Brown et al. | 359/529 |
| 2003/0227351 | A1 | 12/2003 | Sievenpiper | 333/105 |
| 2004/0113713 | A1 | 6/2004 | Zipper et al. | 333/103 |
| 2004/0135649 | A1 | 7/2004 | Sievenpiper | 333/105 |
| 2004/0227583 | A1 | 11/2004 | Shaffner et al. | 333/32 |
| 2004/0227667 | A1 | 11/2004 | Sievenpiper | 343/700 MS |
| 2004/0227668 | A1 | 11/2004 | Sievenpiper | 343/700 MS |
| 2004/0227678 | A1 | 11/2004 | Sievenpiper | 343/702 |

FOREIGN PATENT DOCUMENTS

| | | | |
|---|---|---|---|
| DE | 10 2005 014 164 | A1 * | 10/2006 |
| EP | 0 539 297 | | 4/1993 |
| EP | 1 158 605 | A1 | 11/2001 |
| FR | 2 785 476 | | 5/2000 |
| GB | 1145208 | | 3/1969 |
| GB | 2 281 662 | | 3/1995 |
| GB | 2 328 748 | | 3/1999 |
| JP | 61-260702 | | 11/1986 |
| WO | 94/00891 | | 1/1994 |
| WO | 96/29621 | | 9/1996 |
| WO | 98/21734 | | 5/1998 |
| WO | 99/50929 | | 10/1999 |
| WO | 00/44012 | | 7/2000 |
| WO | 01/31737 | | 5/2001 |
| WO | 01/73891 | A1 | 10/2001 |
| WO | 01/73893 | A1 | 10/2001 |
| WO | 03/098732 | A1 | 11/2003 |

OTHER PUBLICATIONS

Balanis, C., "Microstrip Antennas," *Antenna Theory, Analysis and Design*, 2nd Edition, Ch. 14, pp. 722-736 (1997).

Bialkowski, M.E., et al., "Electronically Steered Antenna System for the Australian Mobilesat," *IEE Proc.-Microw. Antennas Propag.*, vol. 143, No. 4, pp. 347-352 (Aug. 1996).

Bradley, T.W., et al., "Development of a Voltage-Variable Dielectric (VVD), Electronic Scan Antenna," *Radar 97*, Publication No. 449, pp. 383-385 (Oct. 1997).

Chen, P.W., et al., "Planar Double-Layer Leaky-Wave Microstrip Antenna," *IEEE Transactions on Antennas and Propagation*, vol. 50, pp. 832-835 (2002).

Chen, Q., et al., "FDTD diakoptic design of a slot-loop antenna excited by a coplanar waveguide," *Proceedings of the 25th European Microwave Conference 1995*, vol. 2, Conf. 25, pp. 815-819 (Sep. 4, 1995).

Cognard, J., "Alignment of Nematic Liquid Crystals and Their Mixtures," *Mol. Cryst. Liq., Cryst. Suppl. 1*, pp. 1-74 (1982).

Doane, J.W., et al., "Field Controlled Light Scattering from Nematic Microdroplets," *Appl. Phys. Lett.*, vol. 48, pp. 269-271 (Jan. 1986).

Ellis, T.J., et al., "MM-Wave Tapered Slot Antennas on Micromachined Photonic Bandgap Dielectrics," *1996 IEEE MTT-S International Microwave Symposium Digest*, vol. 2, pp. 1157-1160 (1996).

Grbic, A., et al., "Experimental Verification of Backward-Wave Radiation From A Negative Refractive Index Metamaterial," *Journal of Applied Physics*, vol. 92, No. 10, pp. 5930-5935 (Nov. 15, 2002).

Hu, C.N., et al., "Analysis and Design of Large Leaky-Mode Array Employing The Coupled-Mode Approach," *IEEE Transactions on Microwave Theory and Techniques*, vol. 49, No. 4, pp. 629-636 (Apr. 2001).

Jablonski, W., et al., "Microwave Schottky Diode With Beam-Lead Contacts," *13th Conference on Microwaves, Radar and Wireless Communications*, MIKON-2000, vol. 2, pp. 678-681 (2000).

Jensen, M.A., et al., "EM Interaction of Handset Antennas and a Human in Personal Communications," *Proceedings of the IEEE*, vol. 83, No. 1, pp. 1-17 (Jan. 1995).

Jensen, M.A., et al., "Performance Analysis of Antennas for Hand-Held Transceivers Using FDTD," *IEEE Transactions on Antennas and Propagation*, vol. 42, No. 8, pp. 1106-1113 (Aug. 1994).

Lee, J.W., et al . , "TM-Wave Reduction From Grooves in a Dielectric-Covered Ground Plane," *IEEE Transactions on Antennas and Propagation*, vol. 49, No. 1, pp. 104-105 (Jan. 2001).

Linardou, I., et al., "Twin Vivaldi Antenna Fed by Coplanar Waveguide," *Electronics Letters*, vol. 33, No. 22, pp. 1835-1837 (1997).

Malherbe, A., et al., "The Compenasation of Step Discontinues in TEM-Mode Transmission Lines," *IEEE Transactions on Microwave Theory and Techniques*, vol. MTT-26, No. 11, pp. 883-885 (Nov. 1978).

Maruhashi, K., et al., "Design and Performance of a Ka-Band Monolithic Phase Shifter Utilizing Nonresonant FET Switches," *IEEE Transactions on Microwave Theory and Techniques*, vol. 48, No. 8, pp. 1313-1317 (Aug. 2000).

Perini, P., et al., "Angle and Space Diversity Comparisons in Different Mobile Radio Environments," *IEEE Transactions on Antennas and Propagation*, vol. 46, No. 6, pp. 764-775 (Jun. 1998).

Ramo, S., et al., *Fields and Waves in Communication Electronics*, 3rd Edition, Sections 9.8-9.11, pp. 476-487 (1994).

Rebeiz, G.M., et al., "RF MEMS Switches and Switch Circuits," *IEEE Microwave Magazine*, pp. 59-71 (Dec. 2001).

Schaffner, J., et al., "Reconfigurable Aperture Antennas Using RF MEMS Switches for Multi-Octave Tunability and Beam Steering," *IEEE Antennas and Propagation Society International Symposium, 2000 Digest*, vol. 1 of 4, pp. 321-324 (Jul. 16, 2000).

Semouchkina, E., et al., "Numerical Modeling and Experimental Study of a Novel Leaky Wave Antenna," *Antennas and Propagation Society*, IEEE International Symposium, vol. 4, pp. 234-237 (2001).

Sievenpiper, D., et al., "Eliminating Surface Currents With Metallodielectric Photonic Crystals," *1998 MTT-S International Microwave Symposium Digest*, vol. 2, pp. 663-666 (Jun. 7, 1998).

Sievenpiper, D., et al., "High-Impedance Electromagnetic Surfaces With a Forbidden Frequency Band," *IEEE Transactions on Microwave Theory and Techniques*, vol. 47, No. 11, pp. 2059-2074 (Nov. 1999).

Sievenpiper, D., et al., "High-Impedance Electromagnetic Surfaces," *Ph.D. Dissertation*, Dept. Of Electrical Engineering, University of California, Los Angeles, CA, pp. i-xi, 1-150 (1999).

Sievenpiper, D., et al., "Low-Profile, Four-Sector Diversity Antenna on High Impedance Ground Plans," *Electronics Letters*, vol. 36, No. 16, pp. 1343-1345 (Aug. 3, 2000).

Sor, J., et al., "A Reconfigurable Leaky-Wave/Patch Microstrip Aperture For Phased-Array Applications," *IEEE Transactions on Microwave Theory and Techniques*, vol. 50, No. 8, pp. 1877-1884 (Aug. 2002).

Vaughan, Mark J., et al., "InP-Based 28 Ghz Integrated Antennas for Point-to Multipoint Distribution," *Proceedings of the IEEE/Cornell Conference on Advanced Concepts in High Speed Semiconductor Devices and Circuits*, pp. 75-84 (1995).

Vaughan, R., "Spaced Directive Antennas for Mobile Communications by the Fourier Transform Method," *IEEE Transactions on Antennas and Propagation*, vol. 48, No. 7, pp. 1025-1032 (Jul. 2000).

Wang, C.J., et al., "Two-Dimensional Scanning Leaky-Wave Antenna by Utilizing the Phased Array," *IEEE Microwave and Wireless Components Letters*, vol. 12, No. 8, pp. 311-313, (Aug. 2002).

Wu, S.T., et al., "High Birefringence and Wide Nematic Range Bis-Tolane Liquid Crystals," *Appl. Phys. Lett.*, vol. 74, No. 5, pp. 344-346 (Jan. 18, 1999).

Yang, Hung-Yu David, et al., "Theory of Line-Source Radiation From a Metal- Strip Grating Dielectric-Slab Structure," *IEEE Transactions on Antennas and Propagation*, vol. 48, No. 4, pp. 556-564 (2000).

Yashchyshyn, Y., et al., The Leaky-Wave Antenna With Ferroelectric Substrate, *14th International Conference on Microwaves, Radar and Wireless Communications*, MIKON-2002, vol. 2, pp. 218-221 (2002).

Sievenpiper, D., et al., "Beam Steering Microwave Reflector Based on Electrically Tunable Impedance Surface," *Electronics Letters*, vol. 38, No. 21, pp. 1237-1238 (Oct. 10, 2002).

Brown, W.C., "The History of Power Transmission by Radio Waves," *IEEE Transactions on Microwave Theory and Techniques*, vol. MTT-32, No. 9, pp. 1230-1242 (Sep. 1984).

Fay, P., et al., "High-Performance Antimonide-Based Heterostructure Backward Diodes for Millimeter-Wave Detection," *IEEE Electron Device Letters*, vol. 23, No. 10, pp. 585-587 (Oct. 2002).

Gold, S.H.,et al., "Review of High-Power Microwave Source Research," *Rev. Sci. Instrum.*, vol. 68, No. 11, pp. 3945-3974 (Nov. 1997).

Koert, P., et al., "Millimeter Wave Technology for Space Power Beaming," *IEEE Transactions on Microwave Theory and Techniques*, vol. 40, No. 6, pp. 1251-1258 (Jun. 1992).

Lezec, H.J., et al., "Beaming Light from a Subwavelength Aperture," *Science*, vol. 297, pp. 820-821 (Aug. 2, 2002).

McSpadden, J.O.,et al., "Design and Experiments of a High-Conversion-Efficiency 5.8 GHz Rectenna," *IEEE Transactions on Microwave Theory and Techniques*, vol. 46, No. 12, pp. 2053-2060 (Dec. 1998).

Schulman, J.N., et al., "Sb-Heterostructure Interband Backward Diodes,"*IEEE Electron Device Letters*, vol. 21, No. 7, pp. 353-355 (Jul. 2000).

Sievenpiper, D.F., et al., "Two-Dimensional Beam Steering Using an Electrically Tunable Impedance Surface," *IEEE Transactions on Antennas and Propagation*, vol. 51, No. 10, pp. 2713-2722 (Oct. 2003).

Strasser, B., et al., "5.8-GHz Circularly Polarized Rectifying Antenna for Wireless Microwave Power Transmission," *IEEE Transactions on Microwave Theory and Techniques*,vol. 50, No. 8, pp. 1870-1876 (Aug. 2002).

Swartz, N., "Ready for CDMA 2000 1xEV-Do?," *Wireless Review*, 2 pages total (Oct. 29, 2001).

Yang, F.R., et al., "A Uniplanar Compact Photonic-Bandgap(UC-PBG) Structure and its Applications for Microwave Circuits," *IEEE Transactions on Microwave Theory and Techniques*, vol. 47, No. 8, pp. 1509-1514 (Aug. 1999).

Bushbeck, M.D., et al., "a Tunable Switcher Dielectric Grating," *IEEE Microwave and Guided Wave Letters*, vol. 3, No. 9, pp. 296-298 (Sep. 1993).

Chambers, B., et al., "Tunable Radar Absorbers Using Frequency Selective Surfaces," *11th International Conference on Antennas and Propagation*, vol. 50, pp. 832 835 (2002).

Chang, T.K., et al., "Frequency Selective Surfaces on Biased Ferrite Substrates," *Electronics Letters*, vol. 30, No. 15, pp. 1193-1194 (Jul. 21, 1994).

Gianvittorio, J.P., et al., "Reconfigurable MEMES-enabled Frequency Selective Surfaces," *Electronic Letters*, vol. 38, No. 25, pp. 1627 1628 (Dec. 5, 2002).

Lima, A.C., et al., "Tunable Frequency Selective Surfaces Using Liquid Substrates," *Electronic Letters*, vol. 30, No. 4, pp. 281-282 ( Feb. 17, 1994).

Oak, A.C., et al. "A Varactor Tuned 16 Element MESFET Grid Oscillator," *Antennas and Propagation Society International Symposium*. pp. 1296-1299 (1995).

* cited by examiner

REFLECTARRAY

FIELD

The present invention relates to the field of antennas. More particularly, the present invention relates to a reflectarray.

BACKGROUND

Referring to FIG. 1, a microstrip reflectarray 10 is a low profile reflector, consisting of an array of microstrip patch antenna elements 20 disposed on a surface 15 capable of reflecting energy to or from feed 25. Reflectarrays are flat, inexpensive, easy to install and easy to manufacture. By loading each microstrip patch antenna element 20 with a single varactor diode 30, as depicted in FIG. 2, a progressive phase distribution can be achieved in the microstrip reflectarray 10, see the paper by Luigi Boccia, et al., entitled "Experimental Investigation of a Varactor Loaded Reflectarray Antenna," 2002 IEEE MTT-S Digest, pages 69-71. Although the microstrip reflectarray 10 containing microstrip patch antenna elements 20 with varactor diodes 30 allows beam steering, the microstrip reflectarray 10 operates at a single frequency band and in a single polarization.

Unlike prior art, it is possible to operate a reflectarray according to the present disclosure at dual frequencies and it is possible to operate a reflectarray according to the present disclosure at dual frequencies and in dual polarization.

SUMMARY

According to a first aspect, a reflectarray is disclosed, the reflectarray comprising: a first array of conductive patches supported by a substrate, wherein each conductive patch in the first array has a first center line along a Y-direction and a second centerline along an X-direction; a plurality of first variable capacitors, wherein each first variable capacitor is electrically coupled to one of the conductive patches in the first array along the first centerline; and a plurality of second variable capacitors, wherein each second variable capacitor is electrically coupled to one of the conductive patches in the first array along the second centerline.

According to a second aspect, a method for manufacturing a reflectarray is disclosed, the method comprising: forming a first array of conductive patches on a substrate, wherein each conductive patch in the first array has a first center line along a Y-direction and a second centerline along an X-direction; coupling each first variable capacitor of a plurality of first variable capacitors to one of the conductive patches in the first array along the first centerline; and coupling each second variable capacitor of a plurality of second variable capacitors to one of the conductive patches in the first array along the second centerline.

According to a third aspect, a reflectarray is disclosed, the reflectarray comprising: an array of conductive patches supported by a substrate, wherein each conductive patch in the first array has a first center line along a Y-direction and a second centerline along an X-direction; a plurality of first variable capacitors, wherein each first variable capacitor is electrically coupled to one of the conductive patches in the array along the first centerline; a plurality of parasitic elements wherein each parasitic element is disposed adjacent to each of the conductive patches in the array of conductive patches; and a plurality of second variable capacitors, wherein each second variable capacitor is electrically coupled to one of the adjacent parasitic elements the second centerline.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

A phase of a reflection from each patch antenna in a reflectarray may be dictated by the frequency of the resonance for the mode excited in the patch antenna structure. The reflected phase may vary with frequency by 360 degrees around the mode's resonant frequency, and the modes resonance frequency may be varied with a variable capacitor. Thus by using a varactor to vary the resonance frequency of each patch antenna independently, the phase of the energy scattered from each patch antenna may be varied across the surface of the reflectarray. A steerable antenna pattern according to the present disclosure may be used to control the spatial location of the peak in the reflected radiation by controlling the phase of the scattered energy.

Figure 1:
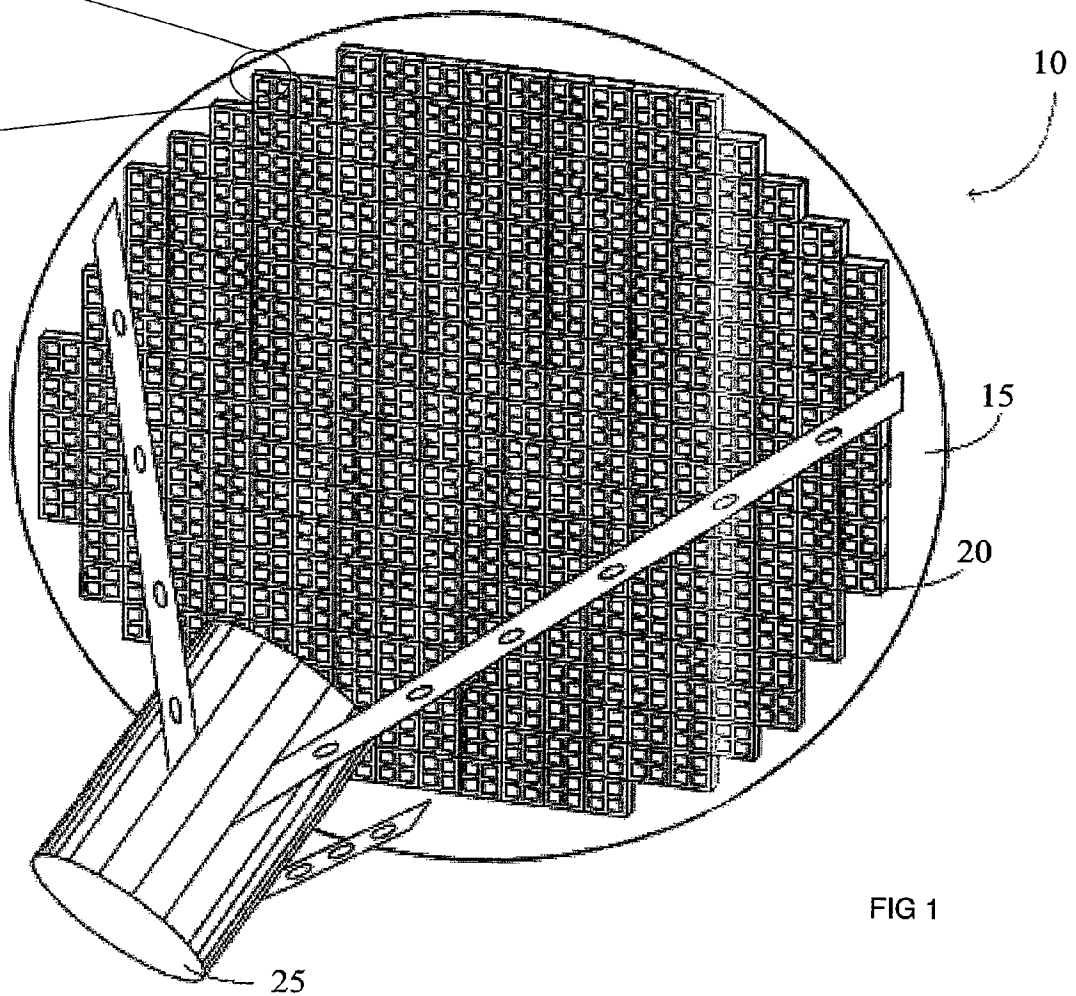
FIG. 1 depicts a microstrip reflectarray, associated with PRIOR ART.
Figure 2:
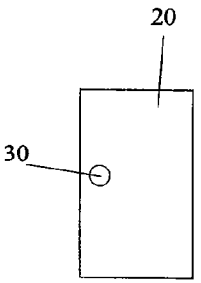
FIG. 2 depicts a microstrip patch antenna element of FIG. 1, associated with PRIOR ART.
Figure 3:
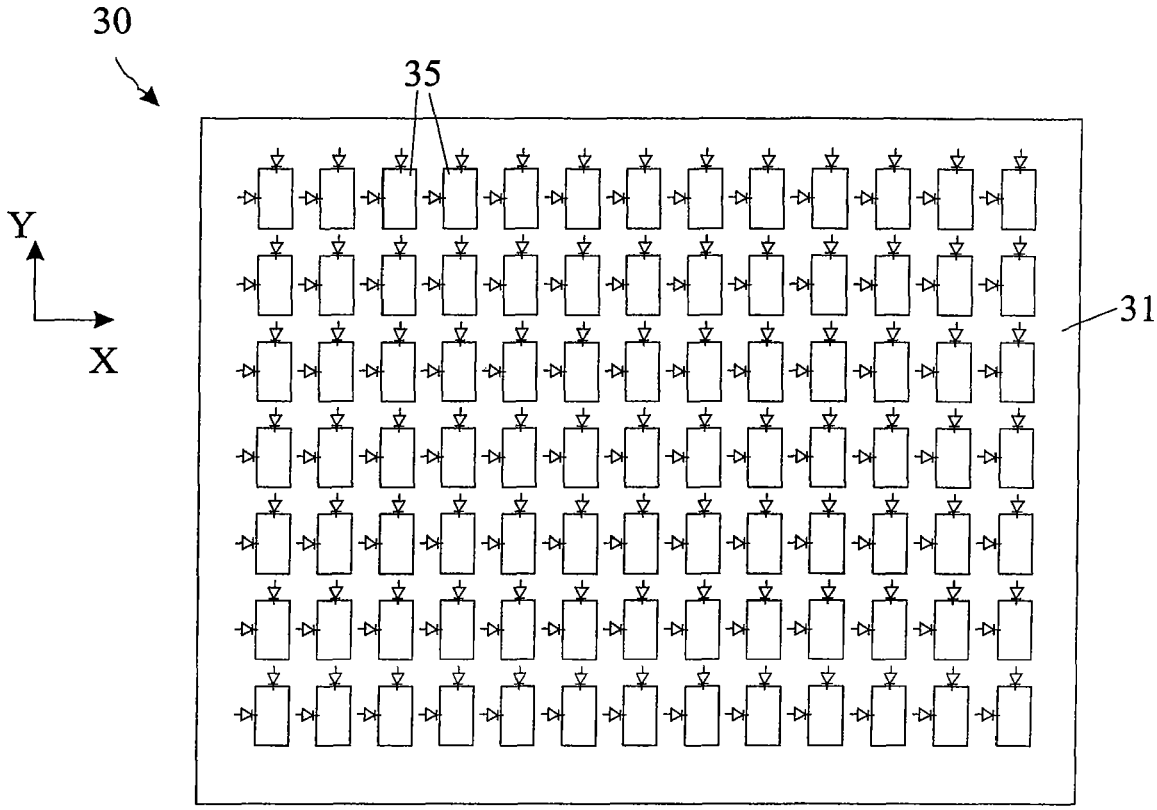
FIG. 3 depicts a reflectarray according to the present disclosure.
Figure 4:
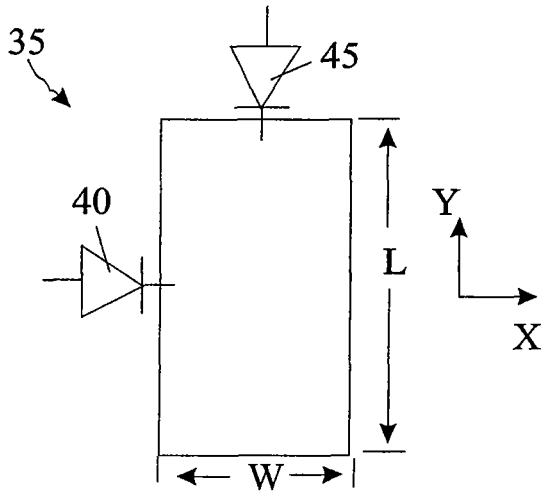
FIG. 4 depicts a rectangular patch of FIG. 3.

Referring to FIG. 3, a reflectarray 30 operable to reflect energy at two different frequencies according to the present disclosure is shown. The reflectarray 30 contains a substrate 31 supporting rectangular patches 35 having a centerline along a Y-direction and another centerline along an X-direction. The patches 35 may be separated by a distance of about ½λ to about 1λ wavelength of the energy to be reflected. Referring to FIG. 4, each rectangular patch 35 has a length L, a width W and contains a varactor diode 45 on the centerline along the Y-direction and a varactor diode 40 on the centerline along the X-direction. In one exemplary embodiment, variable capacitors, Microelectromechanical systems (MEMS) capacitors and/or diodes are used instead of varactor diodes.

The length L of the patches 35 can be used to determine a frequency $f_1$ of the energy polarized along the Y-direction that is going to be reflected off of the patches 35. Specifically, $$f_1 = \frac{(\text{speed of light})}{2L}.$$

Similarly, the width W of the patches 35 can be used to determine a frequency $f_2$ of the energy polarized along the X-direction that is going to be reflected off the patches 35. Specifically, $$f_2 = \frac{(\text{speed of light})}{2W}.$$

By varying the voltage applied to the varactor diode 45, the phase of the reflected energy polarized along the Y-direction can be varied. Similarly, by varying the voltage applied to the varactor diode 40, the phase of the reflected energy polarized along the X-direction can also be varied independently of the energy polarized along the Y-direction.

Figure 5:
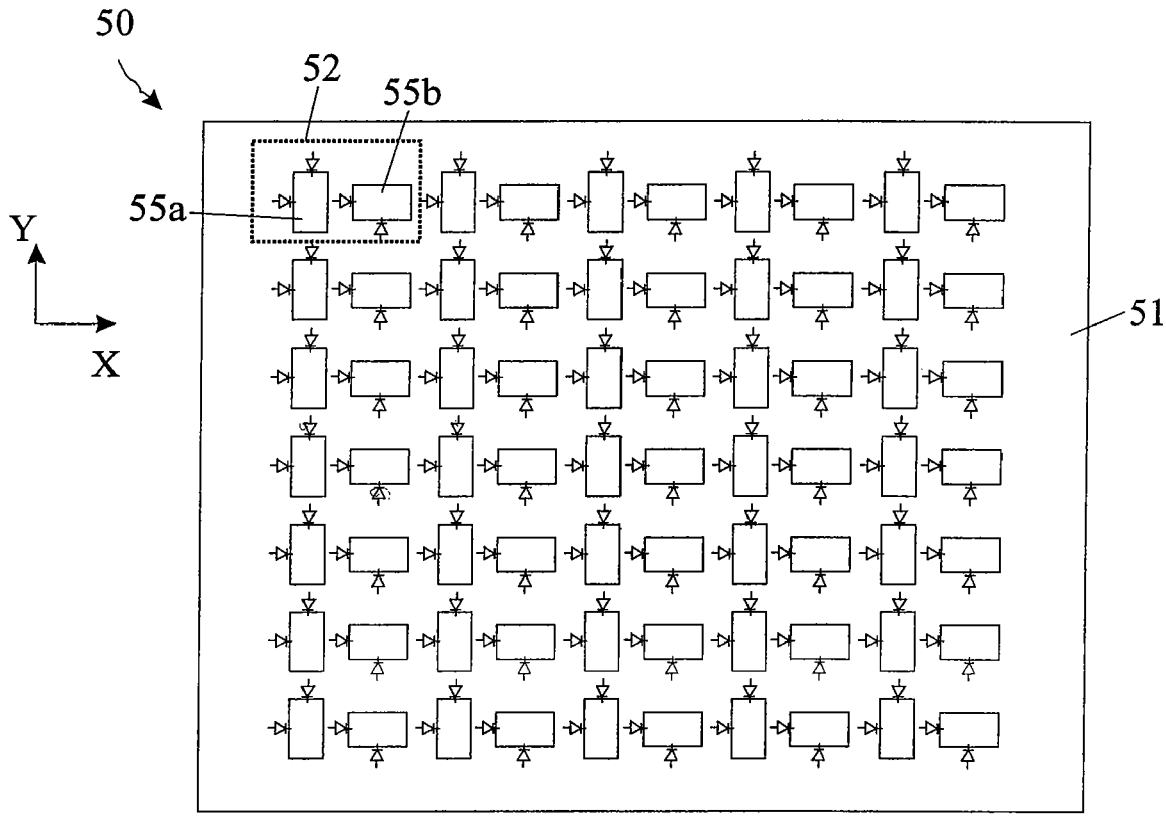
FIG. 5 depicts another reflectarray according to the present disclosure.
Figure 6:
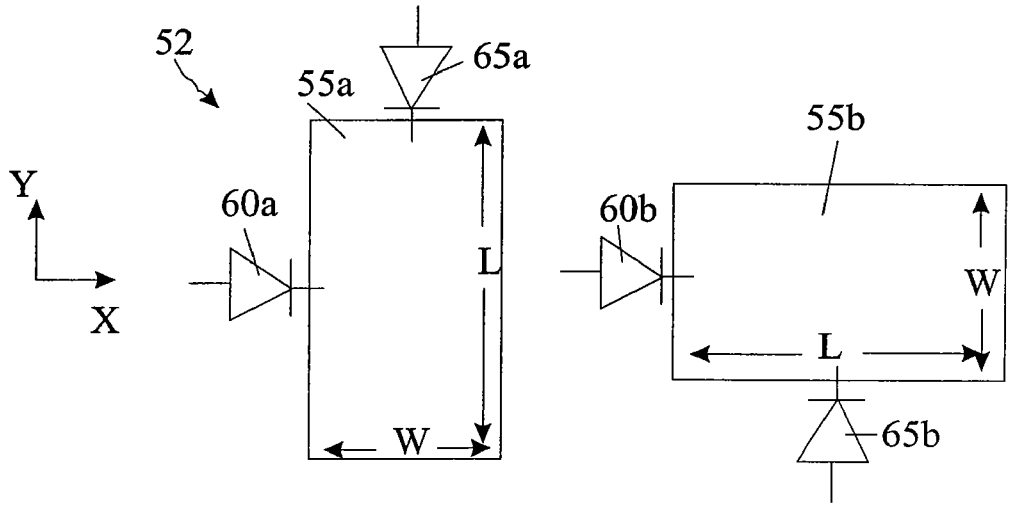
FIG. 6 depicts a unit cell of FIG. 5.

Referring to FIG. 5, a reflectarray 50 operable to reflect energy at two different frequencies in both polarizations according to the present disclosure is shown. The reflectarray 50 contains a substrate 51 supporting a plurality of unit cells 52 containing two rectangular patches 55*a* and 55*b* each having a centerline along the Y-direction and another centerline along the X-direction. The unit cells 52 may be separated by a distance of about ½λ to about 1λ wavelength of the energy to be reflected. Referring to FIG. 6, each rectangular patch 55*a* and 55*b* has a length L, a width W and contains varactor diodes 65*a* and 65*b* on the centerline along the Y-direction and varactor diodes 60*a* and 60*b* on the centerline along the X-direction. In one exemplary embodiment, the length L of the rectangular patch 55*a* is not necessarily equal to the length L of the rectangular patch 55*b*. In another exemplary embodiment, the width W of the rectangular patch 55*a* is not necessarily equal to the width W of the rectangular patch 55*b*.

The length L of the patches 55*a* can be used to determine a frequency $f_1$ of the energy polarized along the Y-direction that is going to be reflected off the patches 55*a*. Specifically, $$f_1 = \frac{(\text{speed of light})}{2L}.$$

Similarly, the width W of the patches 55*a* can be used to determine a frequency $f_2$ of the energy polarized along the X-direction that is going to be reflected off the patches 55*a*. Specifically, $$f_2 = \frac{(\text{speed of light})}{2W}.$$

The length L of the patches 55*b* can be used to determine a frequency $f_1$ of the energy polarized along the X-direction that is going to be reflected off the patches 55*b*, specifically, $$f_1 = \frac{(\text{speed of light})}{2L}.$$

Similarly, the width W of the patches 55*b* can be used to determine a frequency $f_2$ of the energy polarized along the Y-direction that is going to be reflected off the patches 55*b*, specifically, $$f_2 = \frac{(\text{speed of light})}{2W}.$$

By varying the voltages applied to the varactor diodes 60*a*, 60*b*, 65*a* and 65*b*, the phase of the reflected energy for $f_1$ and $f_2$ polarized along the X-direction and Y-direction can be varied.

Figure 7:
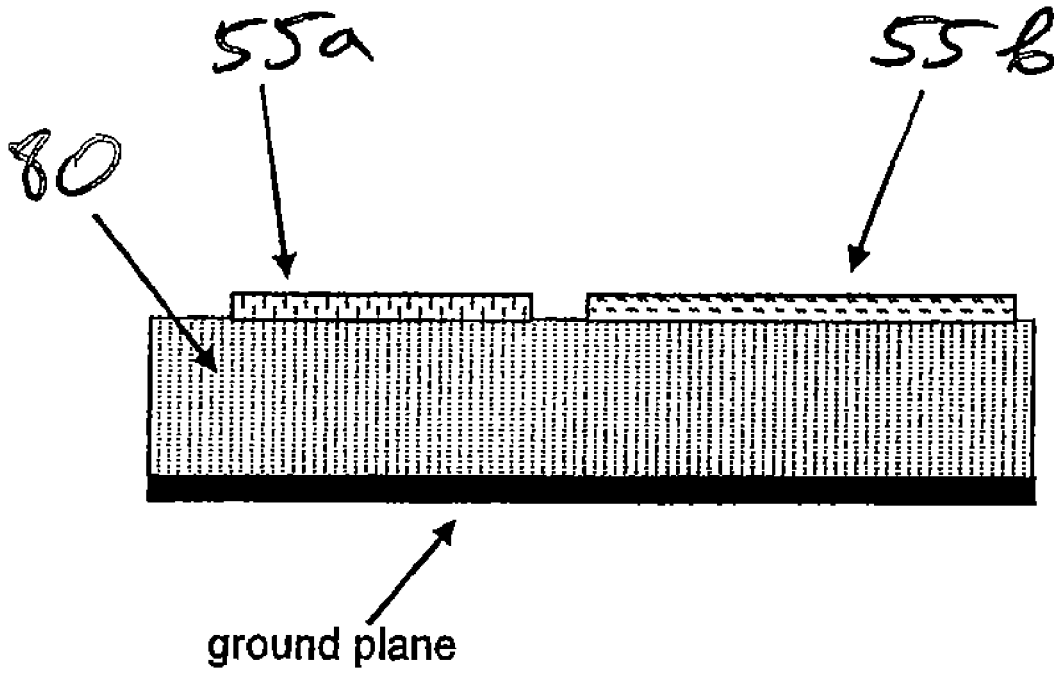
FIG. 7 depicts an exemplary cross section of the unit cell of FIG. 5.
Figure 8:
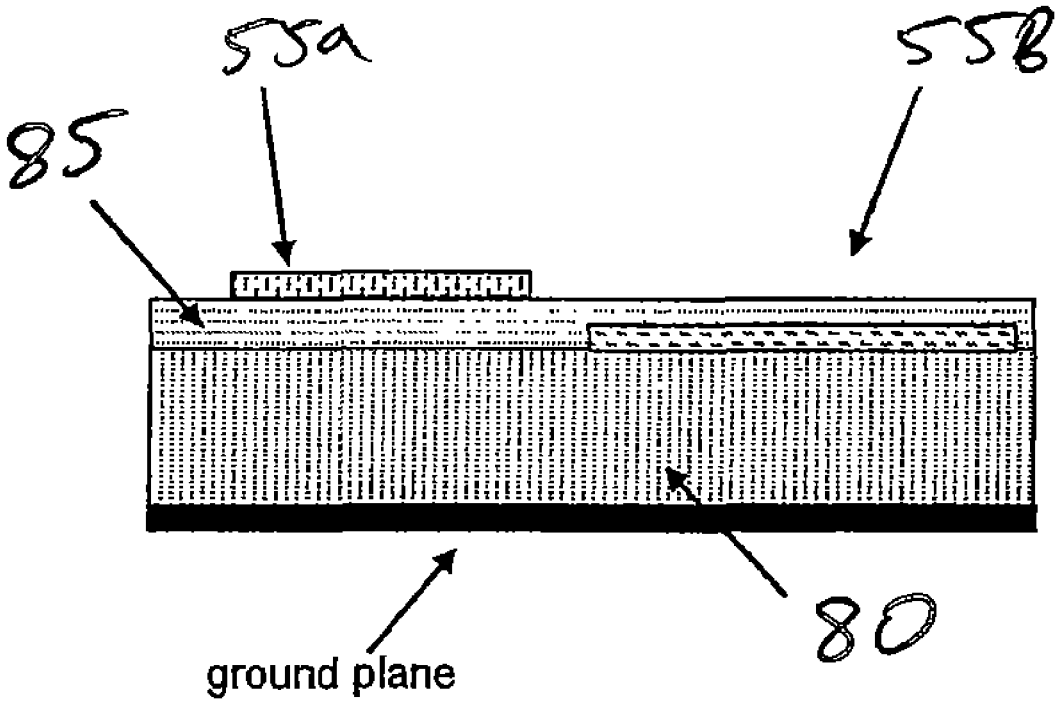
FIG. 8 depicts another exemplary cross section of the unit cell of FIG. 5.

In one exemplary embodiment, the patches 55*a* and 55*b* may be located on the same dielectric layer 80 as shown in FIG. 7. In another exemplary embodiment, the patches 55*a* and 55*b* may be separated by a dielectric layer 85 as shown in FIG. 8.

Figure 9A:
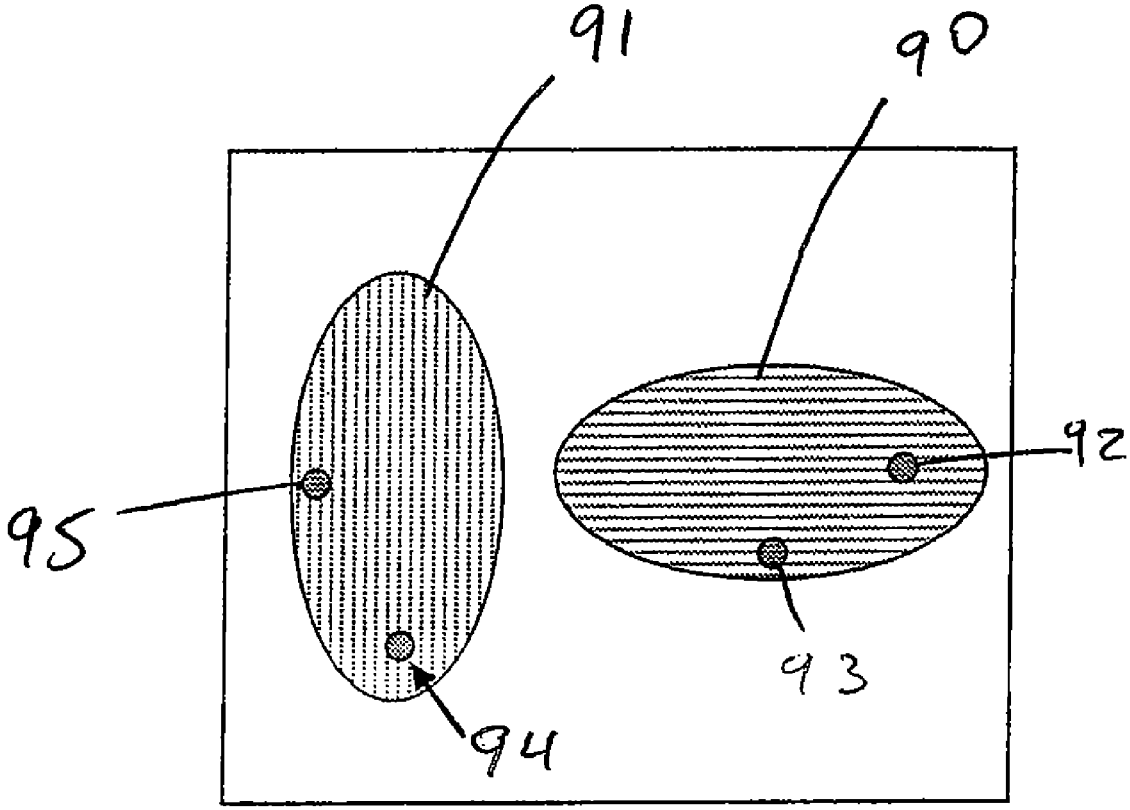
FIGS. 9*a*-9*i* depict exemplary top views of the unit cell of FIG. 6.
Figure 96:
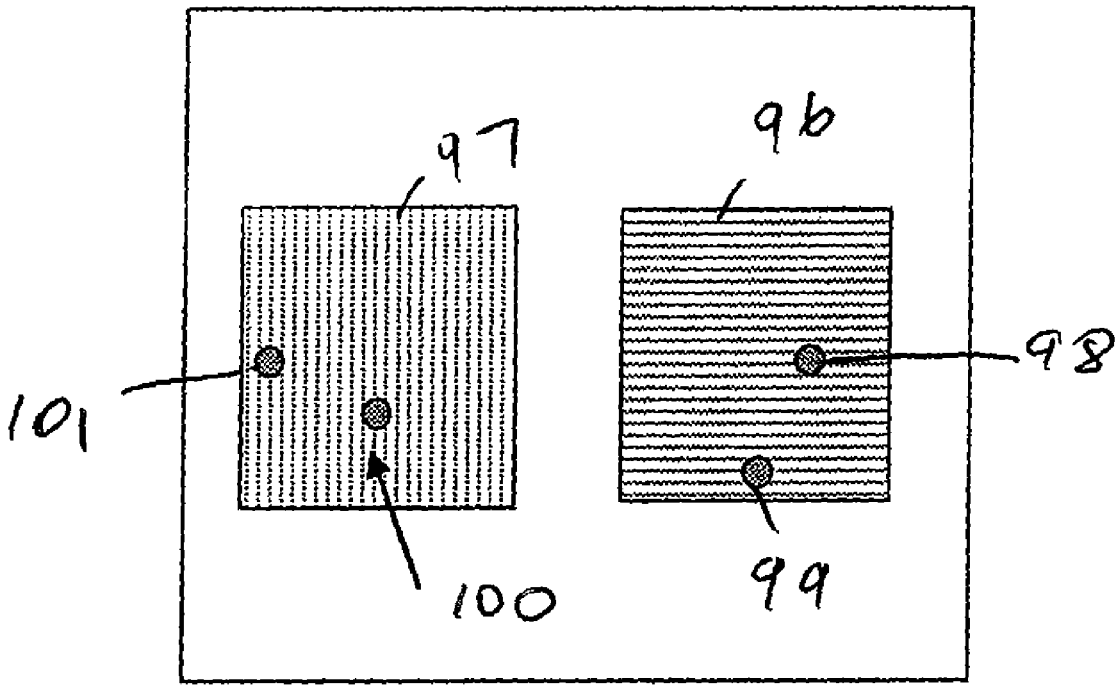
Figure 9C:
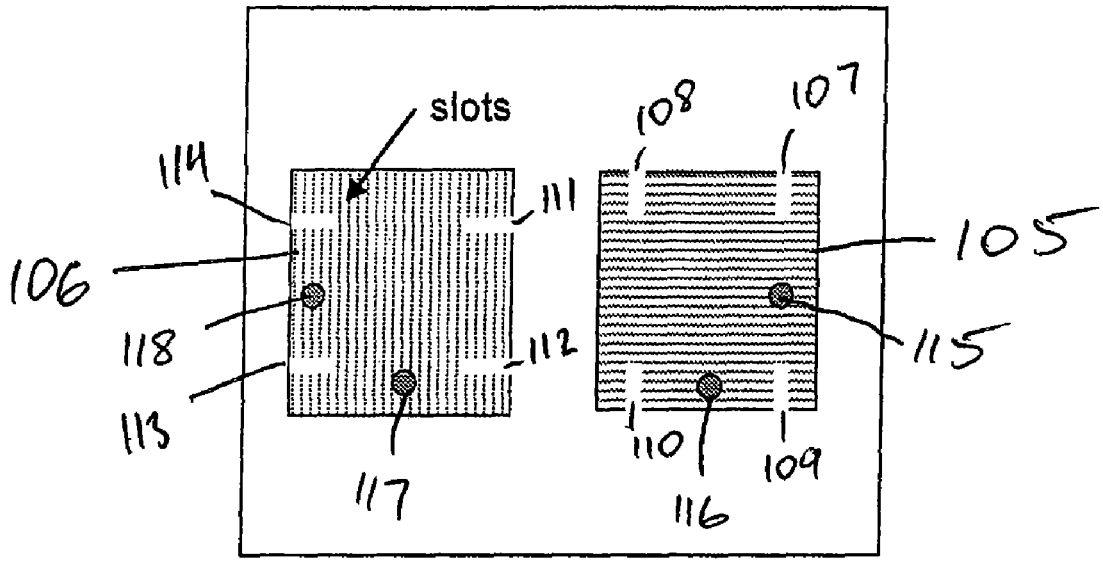
Figure 9L:
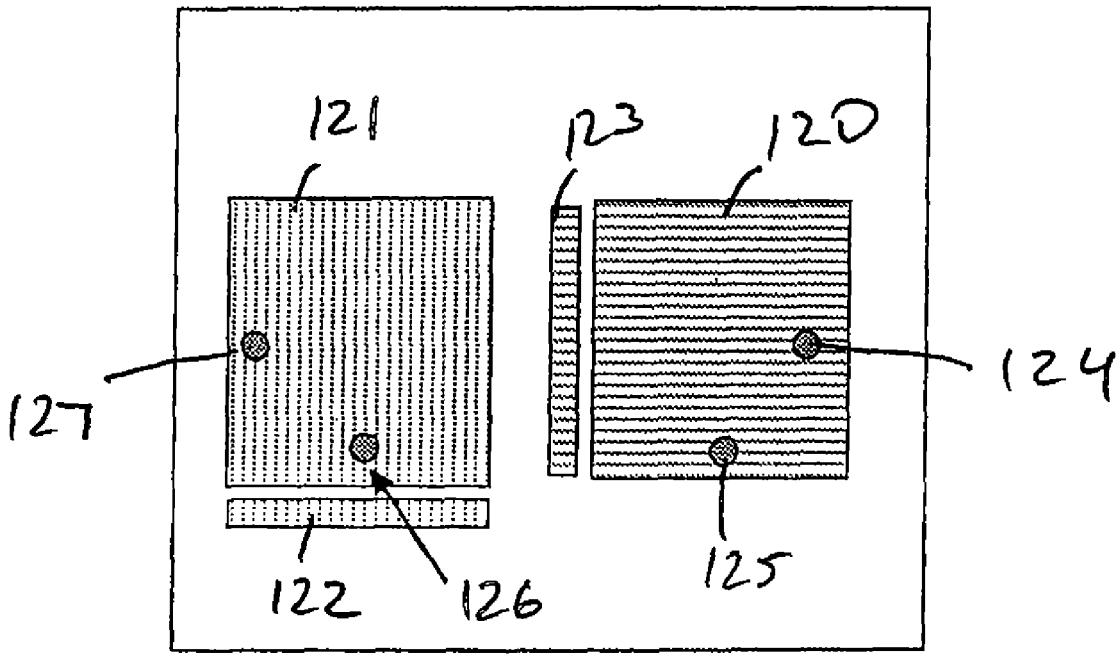
Figure 9E:
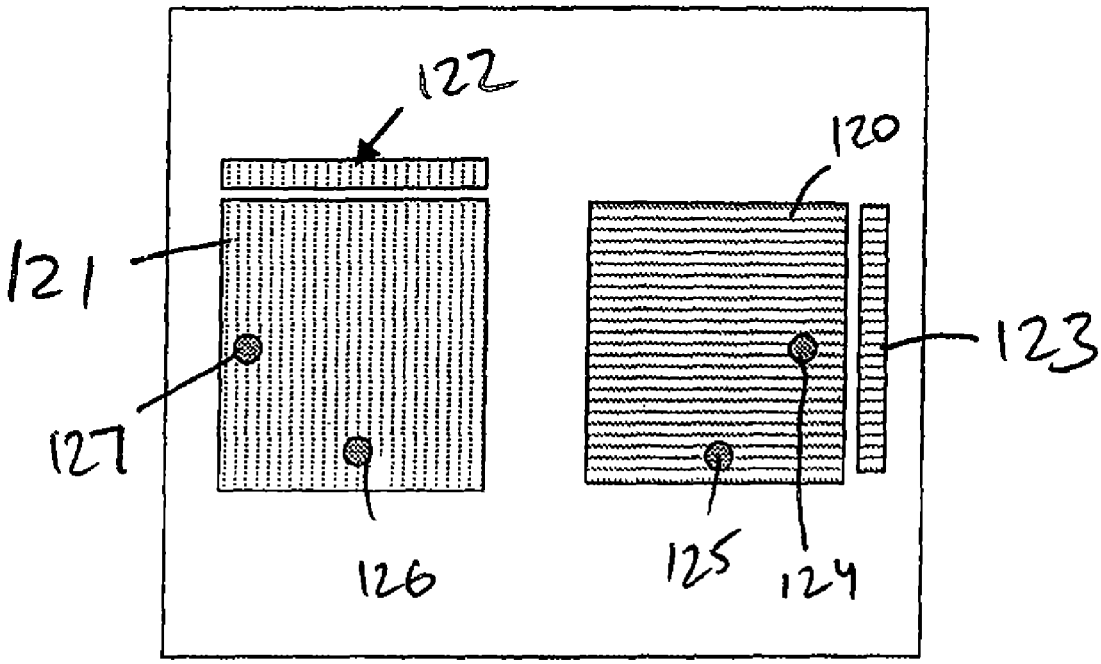
Figure 9F:
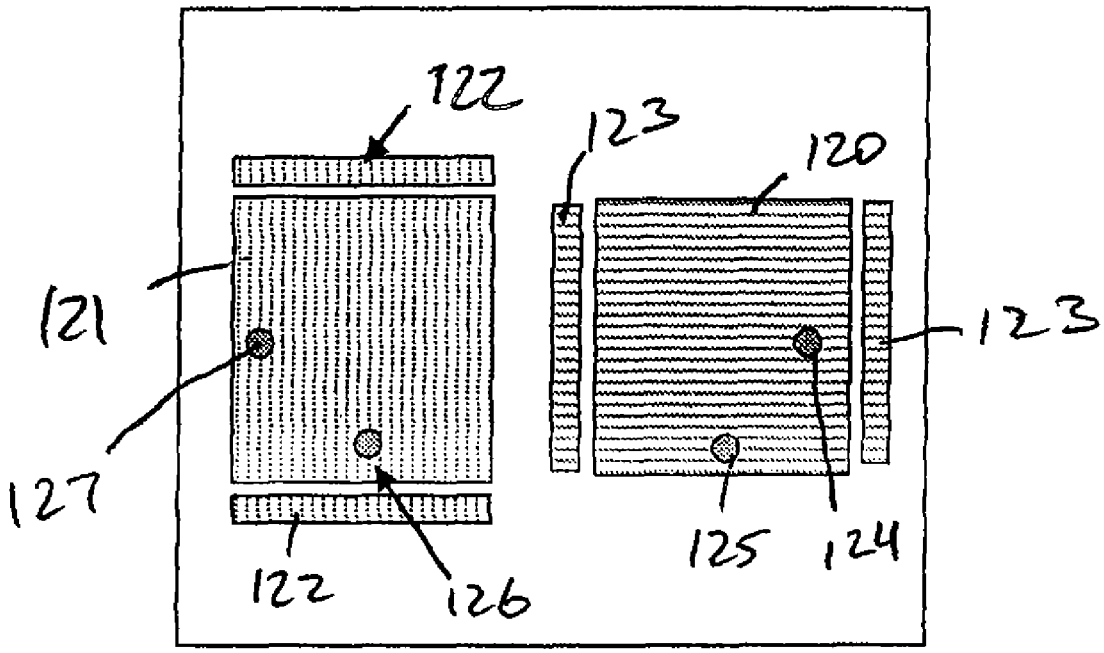
Figure 9G:
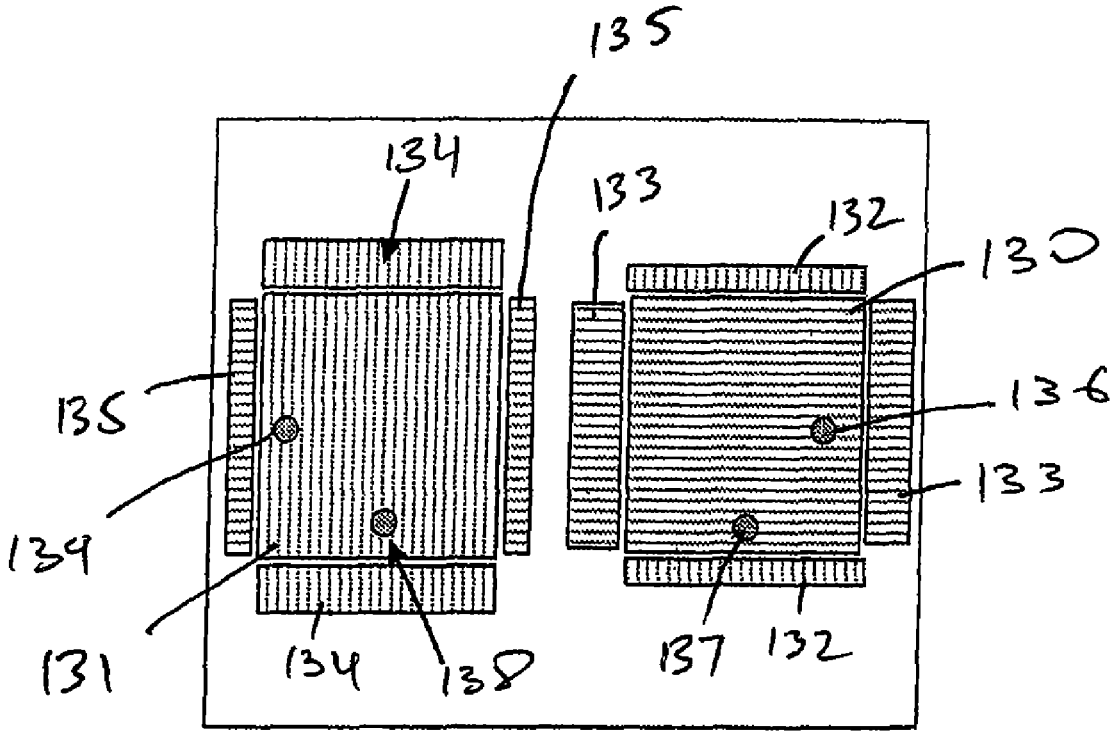
Figure 9H:
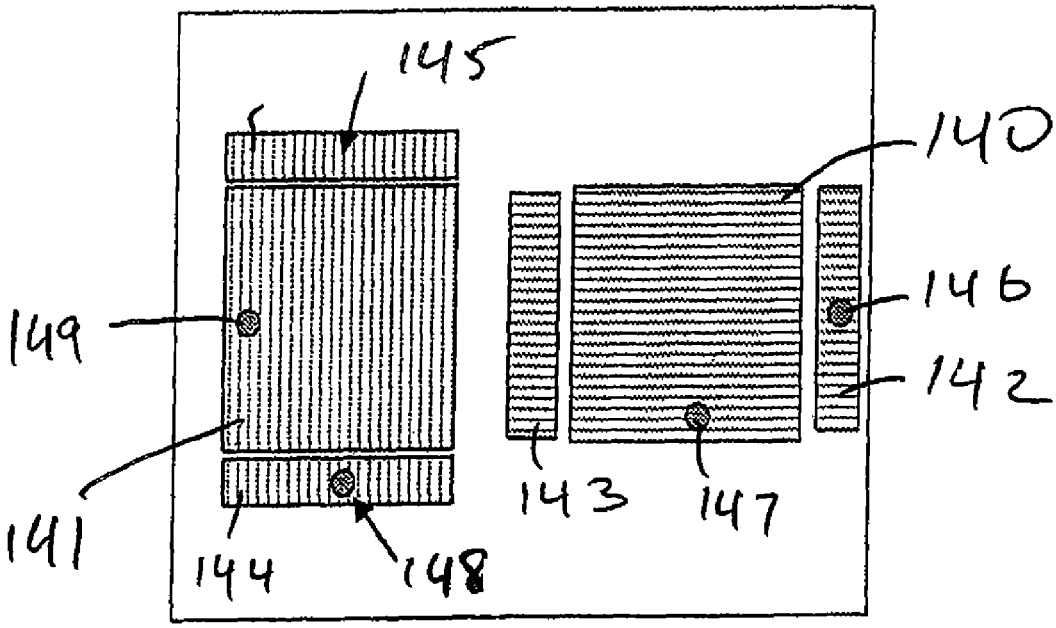
Figure 9I:
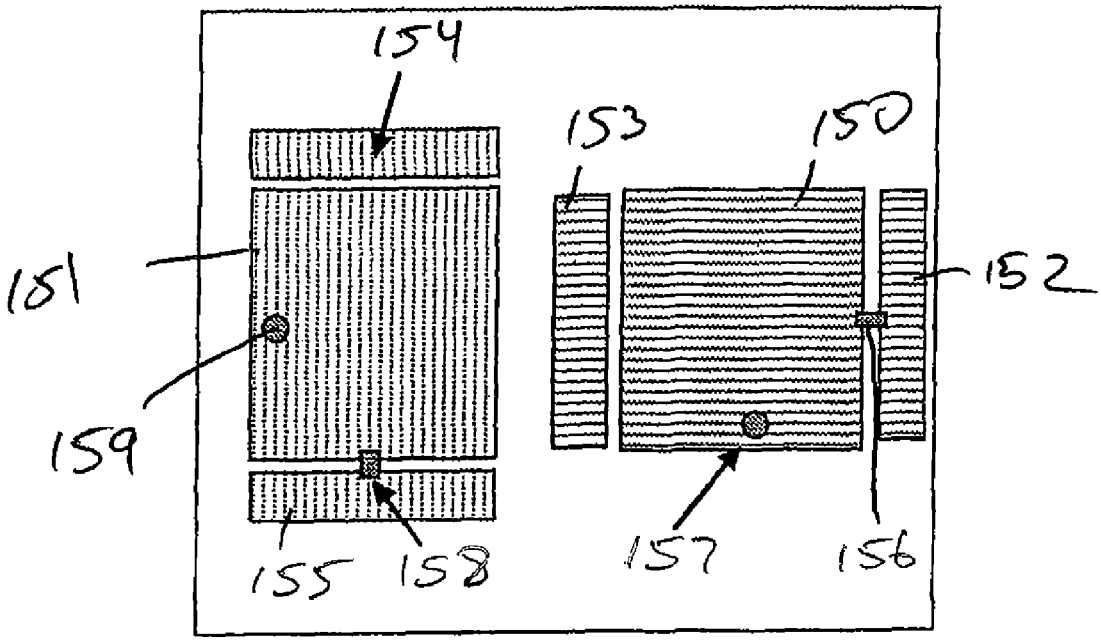

Although FIGS. 3-6 show patches 35, 55*a* and 55*b* as being rectangularly shaped, one skilled in the art can appreciate that other shapes can be used without departing from the scope of the present invention. For example, 1) oval shaped patches 90-91 with varactors 92-95 may be used as shown in FIG. 9*a*; 2) square patches 96-97 with asymmetrically positioned varactors 98-101 may be used as shown in FIG. 9*b*, the asymmetric location of the varactors 98-101 causing two different orthogonal modes to have different resonant frequencies; 3) square patches 105-106 with slots 107-114 and varactors 115-118 may be used as shown in FIG. 9*c*, the mode with the current flow parallel to the side with one of the slots 107-114 will have at a lower resonance frequency than the other perpendicular mode due to the longer effective current path for that mode; 4) square patches 120-121 with parasitic elements 122-123 and varactors 124-127 may be used as shown in FIGS. 9*d*, 9*e* and 9*f*, the parasitic elements 122-123 will decrease the frequency of the mode polarized perpendicular to the edges to which the parasitic elements were introduced; 5) square patches 130-131 with different sized parasitic elements 132-135 with varactors 136-139 may be used as shown in FIG. 9*g*; 6) square patches 140-141 with parasitic elements 142-145 may be used where varactors 146 and 148 are located on the parasitic elements 142 and 148 and varactors 147 and 149 are located on the square patches 140-141 as shown in FIG. 9*g*; and 7) square patches 150-151 with parasitic elements 152-155 may be used where varactors 156 and 158 are located between the patch elements 150-151 and the parasitic elements 152, 158 and where varactors 157, 159 are located on the patch elements 150-151 as shown in FIG. 9*i*.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. A reflectarray for use in combination with a spaced apart antenna feed element, the reflectarray reflecting energy at first and second different frequencies to and/or from said antenna feed element, the reflectarray comprising:

a first array of conductive patches supported by a substrate, wherein each conductive patch in the first array has a first center line along a Y-direction and a second centerline along an X-direction, the conductive patches each having a length dimension and a width dimension, the length dimension being algebraically related to said first frequency and the width dimension being algebraically related to said second frequency for reflecting energy impinging the patches of said first array (i) at said first and second different frequencies and (ii) with different polarizations;

a plurality of first variable capacitors, wherein each first variable capacitor is electrically coupled to one of the conductive patches in the first array along the first centerline; and a plurality of second variable capacitors, wherein each second variable capacitor is electrically coupled to one of the conductive patches in the first array along the second centerline.

2. The reflectarray according to claim 1, further comprising:

a second array of conductive patches supported by the substrate, wherein each patch from the second array is disposed adjacent to at least one patch in the first array, wherein each conductive patch in the second array has a third center line along a Y-direction and a fourth centerline along an X-direction;

a plurality of third variable capacitors, wherein each third variable capacitor is electrically coupled to one of the conductive patches in the second array along the third centerline; and a plurality of fourth variable capacitors, wherein each fourth variable capacitor is electrically coupled to one of the conductive patches in the second array along the fourth centerline.

3. The reflectarray according to claim 2, wherein the conductive patches in the first array and the conductive patches in the second array form a unit cell.

4. The reflectarray according to claim 3, wherein the unit cells are separated by a distance between ½λ to 1λ wavelength of the energy to be reflected by the reflectarray.

5. The reflectarray according to claim 2, wherein the conductive patches of the first array and the conductive patches of the second array are disposed on the substrate.

6. The reflectarray according to claim 2, wherein the conductive patches of the first array and the conductive patches of the second array are separated by a dielectric layer.

7. The reflectarray according to claim 2, wherein the variable capacitors from the plurality of first variable capacitors and the variable capacitors from the plurality of second variable capacitors are asymmetrically coupled to the first array of conductive patches.

8. The reflectarray according to claim 7, wherein the variable capacitors from the plurality of third variable capacitors and the variable capacitors from the plurality of fourth variable capacitors are asymmetrically coupled to the second array of conductive patches.

9. The reflectarray according to claim 2, wherein at least one of conductive patches in the first array of conductive patches defines at least one slot.

10. The reflectarray according to claim 9, wherein at least one of conductive patches in the second array of conductive patches defines at least one slot.

11. The reflectarray according to claim 1, wherein the conductive patches in the first array are separated by a distance between ½λ to 1λ wavelength of the energy to be reflected by the reflectarray.

12. The reflectarray according to claim 1, wherein the first array of conductive patches are substantially rectangular or substantially oval.

13. The reflectarray according to claim 1, wherein at least one of conductive patches in the first array of conductive patches defines at least one slot.

14. The reflectarray according to claim 1, further comprising at least one parasitic element adjacent to one of the conductive patches in the first array of conductive patches.

15. The reflectarray according to claim 14, wherein at least one variable capacitor is coupled to the at least one parasitic element and the adjacent one of the conductive patches in the first array of conductive patches.

16. The reflectarray according to claim 1, wherein variable capacitors are diodes, varactor diodes or MEMS capacitors.

17. The reflectarray according to claim 1 wherein said first frequency is reflected from said reflectarray in a first polarization, wherein said second frequency is reflected from said reflectarray in a second polarization, and wherein said first polarization is orthogonal to said second polarization.

18. A method of making a reflectarray antenna, the method comprising:

directing an antenna feed element towards a reflectarray, the reflectarray reflecting energy at first and second different frequencies to and/or from said antenna feed element;

forming said reflectarray of a first array of conductive patches on a substrate, wherein each conductive patch in the first array has a first center line along a Y-direction and a second centerline along an X-direction, the conductive patches each having a length dimension and a width dimension, the length dimension being algebraically related to said first frequency and the width dimension being algebraically related to said second frequency;

coupling each first variable capacitor of a plurality of first variable capacitors to one of the conductive patches in the first array along the first centerline; and coupling each second variable capacitor of a plurality of second variable capacitors to one of the conductive patches in the first array along the second centerline.

19. The method according to claim 18, further comprising:

forming a second array of conductive patches on the substrate, wherein patches from the second array are formed substantially orthogonally to the patches in the first array, wherein each conductive patch in the second array has a third center line along a Y-direction and a fourth centerline along an X direction, the conductive patches of the second array each having a length dimension and a width dimension, the length dimension being algebraically related to a third frequency and the width dimension being algebraically related to a forth frequency, the third and forth frequencies being different from each other;

coupling each third variable capacitor of a plurality of third variable capacitors to one of the conductive patches in the second array along the third centerline; and coupling each fourth variable capacitor of a plurality of fourth variable capacitors to one of the conductive patches in the second array along the fourth centerline.

20. A reflectarray for use in combination with a spaced apart antenna feed element, the reflectarray reflecting energy at first and second different frequencies to and/or from said antenna feed element, the reflectarray comprising:

an array of conductive patches supported by a substrate, wherein each conductive patch in said array has a first centerline along a first direction and a second centerline along a second direction, the conductive patches each having a length dimension and a width dimension, the length dimension being algebraically related to said first frequency and the width dimension being algebraically related to said second frequency for reflecting energy impinging the patches of said array (i) at said first and second different frequencies and (ii) with different polarizations;

a plurality of first variable capacitors, wherein each first variable capacitor is electrically coupled to one of the conductive patches in the array along the first centerline;

a plurality of parasitic elements wherein each parasitic element is disposed adjacent to each of the conductive patches in the array of conductive patches; and a plurality of second variable capacitors, wherein each second variable capacitor is electrically coupled to one of the adjacent parasitic elements the second centerline.

21. A method of operating a reflectarray antenna at first and second different frequencies, the method comprising:

supporting an array of conductive patches by a substrate, wherein each conductive patch in said array has a first centerline along a first direction and a second centerline along a second orthogonal direction, the conductive patches each having a length dimension and a width dimension, the length dimension being algebraically related to said first frequency and the width dimension being algebraically related to said second frequency;

a plurality of first variable capacitors, wherein each first variable capacitor is electrically coupled to one of the conductive patches in the array along the first centerline;

a plurality of second variable capacitors, wherein each second variable capacitor is electrically coupled to one of the conductive patches in the array along the second centerline;

varying a voltage applied to said plurality of first variable capacitors whereby a phase of reflected energy from said reflectarray is polarized along a first direction is thereby varied; and varying a voltage applied to said plurality of second variable capacitors whereby a phase of reflected energy polarized along a second direction is thereby varied.

22. A reflectarray for use in combination with a spaced apart antenna feed element, the reflectarray reflecting energy at first and second different frequencies to and/or from said antenna feed element, the reflectarray comprising:

first and second arrays of conductive patches disposed by a substrate, each conductive patch of the first array having a length dimension and a width dimension, the length dimension being longer than the width dimension and therefor having a corresponding direction of elongation, the length dimension of each conductive patch of the first array being algebraically related to said first frequency and the width dimension of each conductive patch of the first array being algebraically related to said second frequency for reflecting energy impinging the patches of said first array at said first and second different frequencies, each conductive patch of the second array having a length dimension and a width dimension, the length dimension of the patches of the second array being longer than the width dimension of the patches of the second array and therefor having a corresponding direction of elongation, the patches of the first array being disposed with their directions of elongation being parallel to one another, the patches of the second array being disposed with their directions of elongation being (i) parallel to one another and (ii) orthogonal to the directions of elongation of the patches of the first array whereby the reflectarray reflects energy at said first and second different frequencies and at each of two different orthogonal directions of polarization.

23. The reflectarray according to claim 22 wherein the length dimension of each conductive patch of the second array being algebraically related to said first frequency and the width dimension of each conductive patch of the second array being algebraically related to said second frequency.

24. A reflectarray comprising:

a first array of conductive patches supported by a substrate, wherein each conductive patch in the first array has a first center line along a Y-direction and a second centerline along an X-direction;

a plurality of first variable capacitors, wherein each first variable capacitor is electrically coupled to one of the conductive patches in the first array along the first centerline; and a plurality of second variable capacitors, wherein each second variable capacitor is electrically coupled to one of the conductive patches in the first array along the second centerline, wherein the variable capacitor from the plurality of first variable capacitors and the variable capacitors from the plurality of second variable capacitors are asymmetrically coupled to the first array of conductive patches.

25. The reflectarray according to claim 24, further comprising:

a second array of conductive patches supported by the substrate, wherein each patch from the second array is disposed adjacent to at least one patch in the first array, wherein each conductive patch in the second array has a third center line along a Y-direction and a fourth centerline along an X-direction;

a plurality of third variable capacitors, wherein each third variable capacitor is electrically coupled to one of the conductive patches in the second array along the third centerline; and a plurality of fourth variable capacitors, wherein each fourth variable capacitor is electrically coupled to one of the conductive patches in the second array along the fourth centerline.

26. The reflectarray according to claim 25, wherein the variable capacitors from the plurality of first variable capacitors and the variable capacitors from the plurality of second variable capacitors are asymmetrically coupled to the first array of conductive patches.

27. The reflectarray according to claim 26, wherein the variable capacitors from the plurality of third variable capacitors and the variable capacitors from the plurality of fourth variable capacitors are asymmetrically coupled to the second array of conductive patches.

* * * * *